US005282417A

United States Patent [19]

Germann

[11] Patent Number: 5,282,417

[45] Date of Patent: Feb. 1, 1994

[54] INTAGLIO PRINTING MACHINE WITH DIRECT AND COLOR-COLLECT INKING

[75] Inventor: Albrecht J. Germann, Würzburg, Fed. Rep. of Germany

[73] Assignee: De La Rue Giori S.A., Lausanne, Switzerland

[21] Appl. No.: 23,216

[22] Filed: Feb. 25, 1993

[30] Foreign Application Priority Data

Mar. 26, 1992 [CH] Switzerland ..... 973/92

[51] Int. Cl.[5] ..... B41F 9/02

[52] U.S. Cl. ..... 101/152; 101/167; 101/177; 101/232; 101/331; 101/352; 101/DIG. 49

[58] Field of Search ..... 101/216, 150, 151, 152, 101/153, 155, 170, 174, 175, 177, 183, 211, 216, 218, 232, 247, 248, 328, 329, 330, 331, 352, DIG. 49

[56] References Cited

U.S. PATENT DOCUMENTS

| | | | |
|---|---|---|---|
| 3,759,177 | 9/1973 | Gazzola et al. | 101/232 |
| 3,762,319 | 10/1973 | Gazzola et al. | 101/152 |
| 3,835,776 | 9/1974 | Weidman | 101/232 |
| 3,889,596 | 6/1975 | Thomas et al. | 101/154 |
| 4,516,496 | 5/1985 | Giori | 101/152 |
| 4,960,049 | 10/1990 | Mimura et al. | 101/183 |
| 5,042,378 | 8/1991 | Germann | 101/152 |
| 5,062,359 | 11/1991 | Giori | 101/152 |
| 5,062,360 | 11/1991 | Germann et al. | 101/177 |

*Primary Examiner*—Eugene H. Eickholt
*Attorney, Agent, or Firm*—Kane, Dalsimer, Sullivan, Kurucz, Levy, Eisele Richard

[57] ABSTRACT

The intaglio printing machine has three machine stands (I, II, III). Essentially, the impression cylinder (1) and the plate cylinder (2) are mounted in the first stand (I), the stencil rollers (10) and the inking unit (11) are mounted in the second stand (II), and the color-collect cylinder (8) is mounted in the third stand (III). The third stand (III) is adjustable in such a way that it can be removed from the space between the first and second stands and brought into an inoperative position, so that it is possible to bring the second stand (II) up against the first stand (I) to form an intaglio printing machine with direct inking. This results in a convertible intaglio printing machine by means of which a collect intaglio print can be made in a first operating position, in which all three stands assume their working position, and a direct intaglio print can be made in a second operating position, with the use of only the first and second stands.

9 Claims, 5 Drawing Sheets

FIG. 5
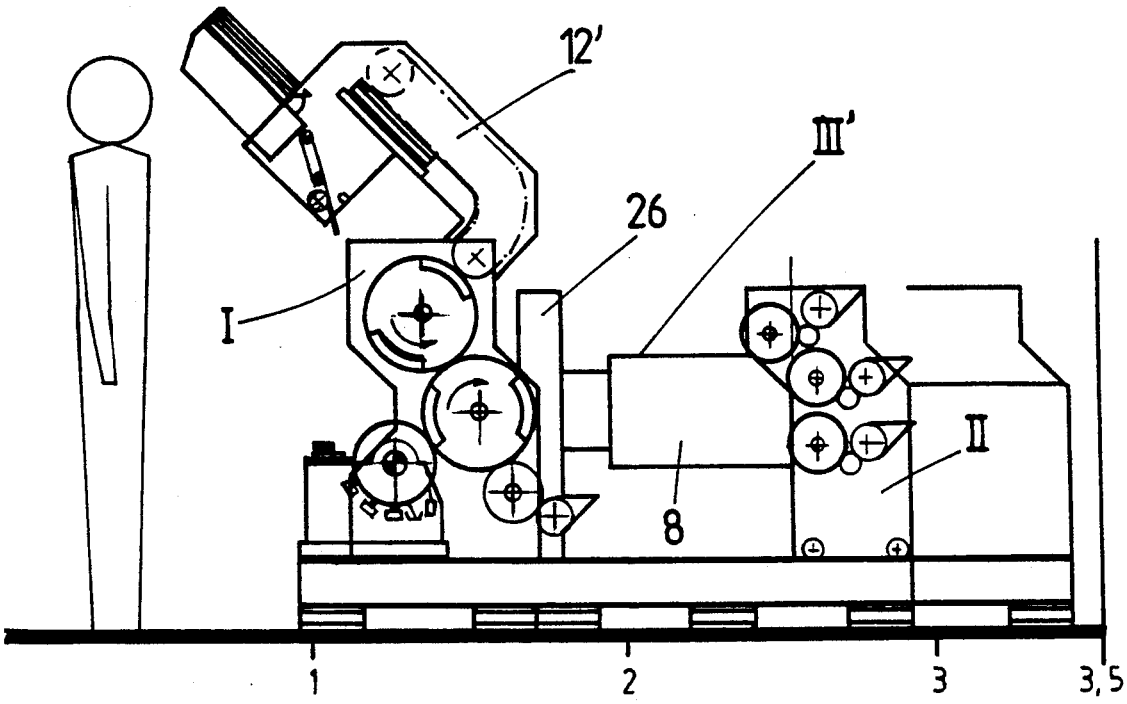
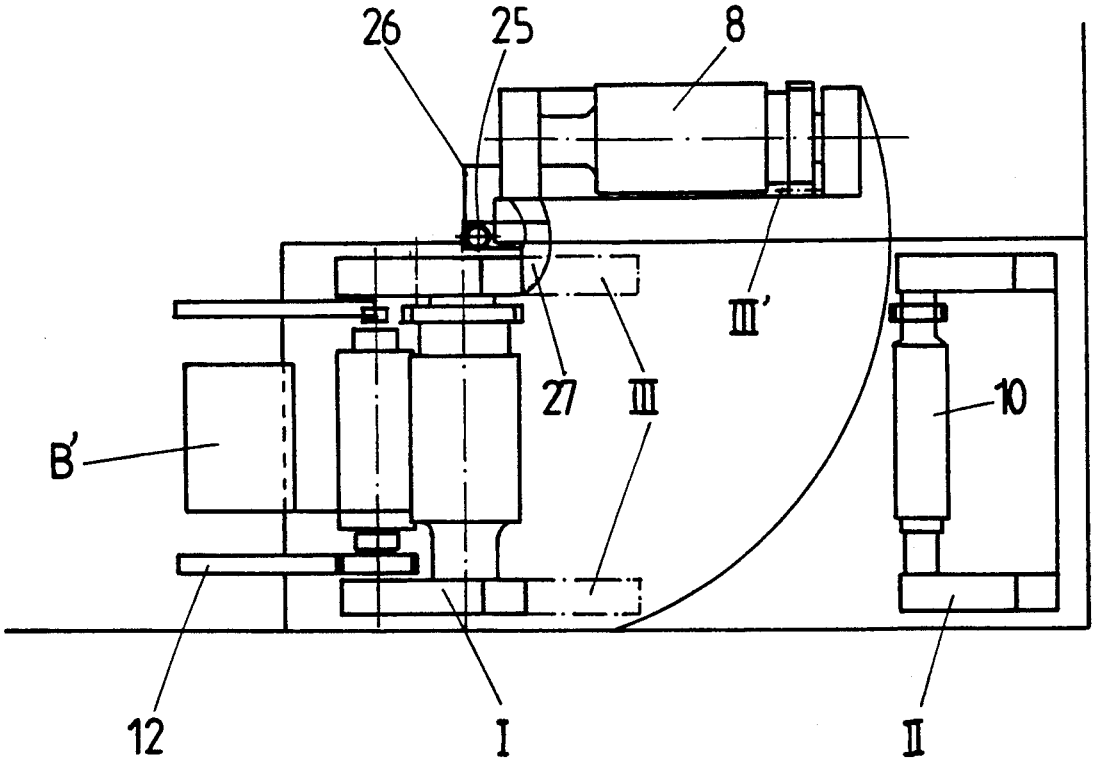
FIG. 6

INTAGLIO PRINTING MACHINE WITH DIRECT AND COLOR-COLLECT INKING

FIELD OF THE INVENTION

The invention relates to an intaglio printing machine according to the preamble of claim 1.

PRIOR ART

An intaglio printing machine of this type is known from U.S. Pat. No. 5,062,359 of the same applicant. In this machine, the intaglio printing plates are not inked with various colors directly by the stencil rollers, but the zones of differing color are first transferred from the stencil rollers onto the color-collector cylinder, are collected there in register and only then passed from this color-collector cylinder onto the intaglio printing plates. One advantage of this intaglio printing machine, as compared with a conventional intaglio printing machine having a direct inking of the printing plates, is that a perfect register between the various color zones on the intaglio printing plate can be obtained in a simple way. Moreover, since the color-collect cylinder is provided with a smooth elastic surface, the stencil rollers, which define the various color zones and which cooperate with the elastic surface of the color-collect cylinder, can consist of a harder material than hitherto, so that the finest possible relief-like regions, which experience virtually no deformation when pressed against the color-collect cylinder, can be produced. This indirect or collect intaglio printing machine therefore serves especially for producing the safety background of banknotes, which, as is known, consists of fine colored lines and of other fine colored elements, and, if appropriate, also at the same time for producing the main design of banknotes.

Of course, there is often also the need to work by the conventional direct intaglio printing process, that is to say with a conventional intaglio printing machine having direct inking.

Two separate printing machines have hitherto been required for these two versions of intaglio printing.

SUMMARY OF THE INVENTION

The object on which the present invention is based is to overcome this disadvantage and to provide a convertible intaglio printing machine, by means of which the work can be carried out either by the method of collect intaglio printing or else by that of direct intaglio printing. This selective possibility is advantageous especially in a so-called proof-printing machine which, as a rule, is used for making test prints at the start of production of a new printed product.

To achieve this object, the intaglio printing machine according to the invention is obtained by means of the features indicated in the defining part of claim 1.

Thus, the printing machine accommodated in three separate machine stands can be used in a simple way either for indirect or collect intaglio printing, if all three stands are employed, or else for direct intaglio printing, if the second stand together with the collector cylinder is omitted.

Where a sheet-fed printing machine is concerned, the sheet feeder and the sheet delivery as well as preferably also the entry table for the entry stack and the delivery table are all accommodated in a common stand which is pivotably mounted in the upper region of the first machine stand, above the impression cylinder, in such a way that it is adjustable between an operating position and an inoperative position, in which the cylinders are easily accessible.

BRIEF DESCRIPTION OF THE DRAWINGS

The invention is explained in more detail by means of two exemplary embodiments with reference to the drawings. In these:

FIG. 5 shows a side view of a further diagrammatically represented embodiment of an intaglio printing machine according to the invention, and FIG. 6 shows a top view, the third machine stand together with the color-collect cylinder being pivoted laterally into its inoperative position.

DESCRIPTION OF THE PREFERRED EMBODIMENTS

Figure 1:
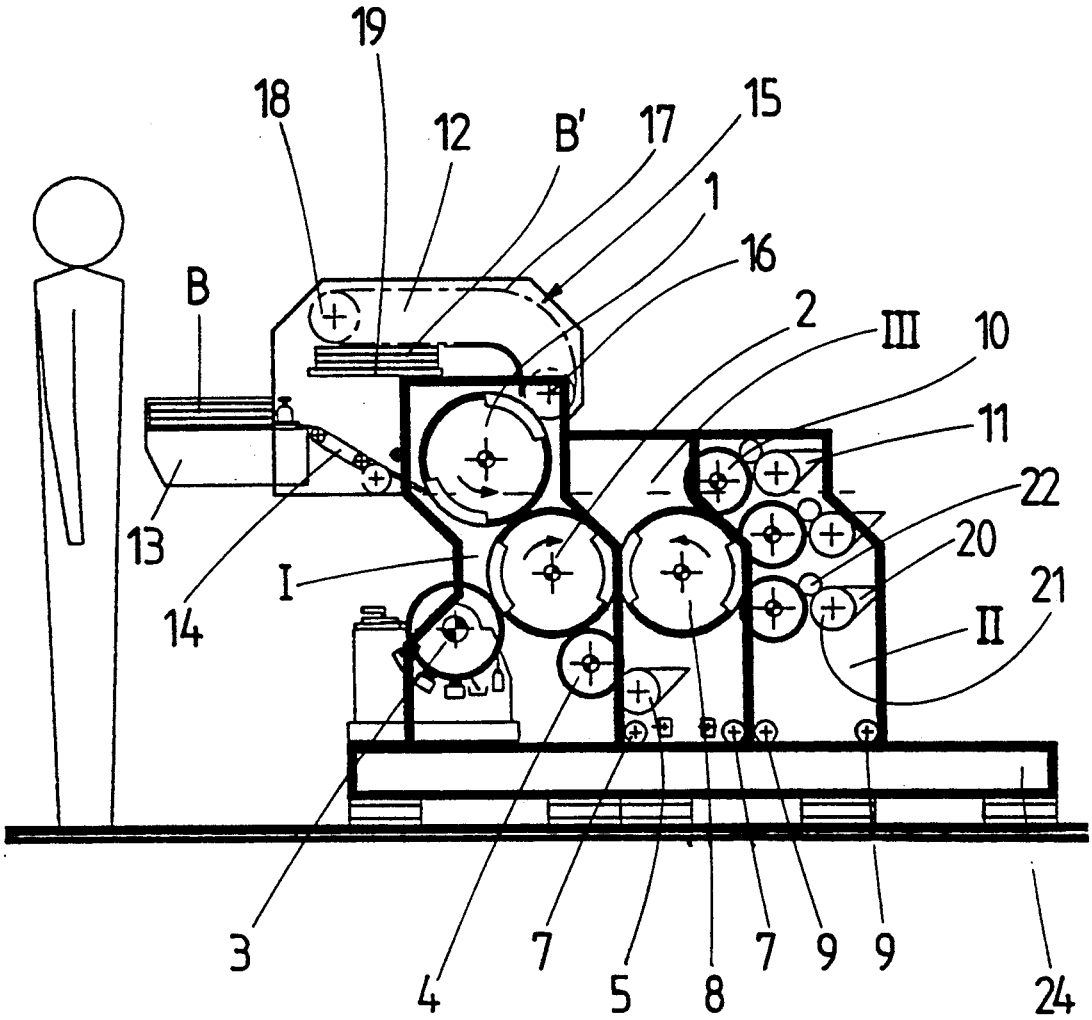
FIG. 1 shows an intaglio printing machine according to the invention in that operating position in which all three machine stands form a collect intaglio printing machine.

The intaglio printing machine, which is a sheet-fed printing machine in the examples under consideration, has three machine stands, I, II and III. In machine stand I are mounted an impression cylinder 1, a plate cylinder 2 which cooperates with this and which carries two intaglio printing plates in the example under consideration, and the wiping cylinder 3 of a wiping device. Mounted in machine stand III is a color-collector cylinder 8 which has the same diameter as the plate cylinder 2 and which has a surface consisting of elastic material. In machine stand II are mounted a plurality of stencil rollers 10, three stencil rollers in the example under consideration, and the inking units 11 assigned to these.

The entry table 13 for the entry stack B of sheets, the sheet feeder 14 and the device for supplying sheets to the impression cylinder 1 as well as the sheet-removal device together with the sheet delivery 15 and the delivery table 19 for the exit stack B' are mounted, in the examples under consideration, in a common stand 12 which is pivotable about a horizontal axis in the upper region of the machine stand I. It can therefore be pivoted upwards out of its operating position shown in FIGS. 1 and 4 into an inoperative position 12' shown in FIGS. 2, 3, 5 and 6, so that the impression cylinder 1 and the plate cylinder 2 are freely accessible, especially for purposes of maintenance or exchange. Moreover, the accommodation of all the elements necessary for the sheet supply and the sheet discharge in a single adjustable stand simplifies the construction of the machine. In the example under consideration, the sheet-removal device has a chain-gripper system with an endless gripper chain 17 which runs over two chain wheels 16 and 18, the axis of the chain wheel 16 at the same time being the pivot axis of the stand 12.

Furthermore, in the examples under consideration, there is also provided in machine stand I a bearing for receiving a further cylinder which can be either a pre-wiping cylinder 4' (FIG. 4) or else a further stencil roller 4 (FIG. 1) for the direct inking of the intaglio printing plates on the plate cylinder 2, this stencil roller 4 being inked by an inking unit 5 likewise mounted on the machine stand I.

All the machine stands I, II and III rest on a baseplate 24. Machine stand II is equipped with rollers 9, on which it is movable perpendicularly to the roller axes and can consequently be moved off from machine stand I or II. In the example according to FIGS. 1 to 4, machine stand III is equipped, on the one hand, with a first group of rollers 7, the axes of which are parallel to the cylinder axis, and, on the other hand, with a second group of rollers 23, the axes of which are perpendicular to the cylinder axis. All the rollers of one group or the other can be retracted selectively in such a way that machine stand III either rests only on the rollers 7 (FIG. 1), so that it can be moved off from machine stand I in the same direction as machine stand II, or is supported only on the rollers 23 (FIG. 2) which, in this case, allow a transverse displacement parallel to the cylinder axis. Known mechanical, hydraulic or electrical means can be provided for retracting and extending the rollers 7 and 23.

In the operating position according to FIG. 1, in which an indirect or collect intaglio printing can be carried out, all three machine stands I, II and II are in their working position. The directions of rotation of all the cylinders are indicated by arrows. The stencil rollers 10 are cut out in a known way in such a manner that they have relief zones, the circumference of which corresponds exactly to the regions of the intaglio printing plates to be inked in the respective colors. The various colors are collected in register on the color-collect cylinder 8 and are transferred jointly onto the printing plates of the plate cylinder 2. In the example according to FIG. 1, therefore, the printing plates are inked via the color-collect cylinder 8 with three colors and via the additional stencil roller 4 directly with a further color. In particular, the three-color image originating from the stencil rollers 10 can be the safety background of a banknote, and the single-color image originating from the stencil roller 4 can be the main design of a banknote.

Figure 2:
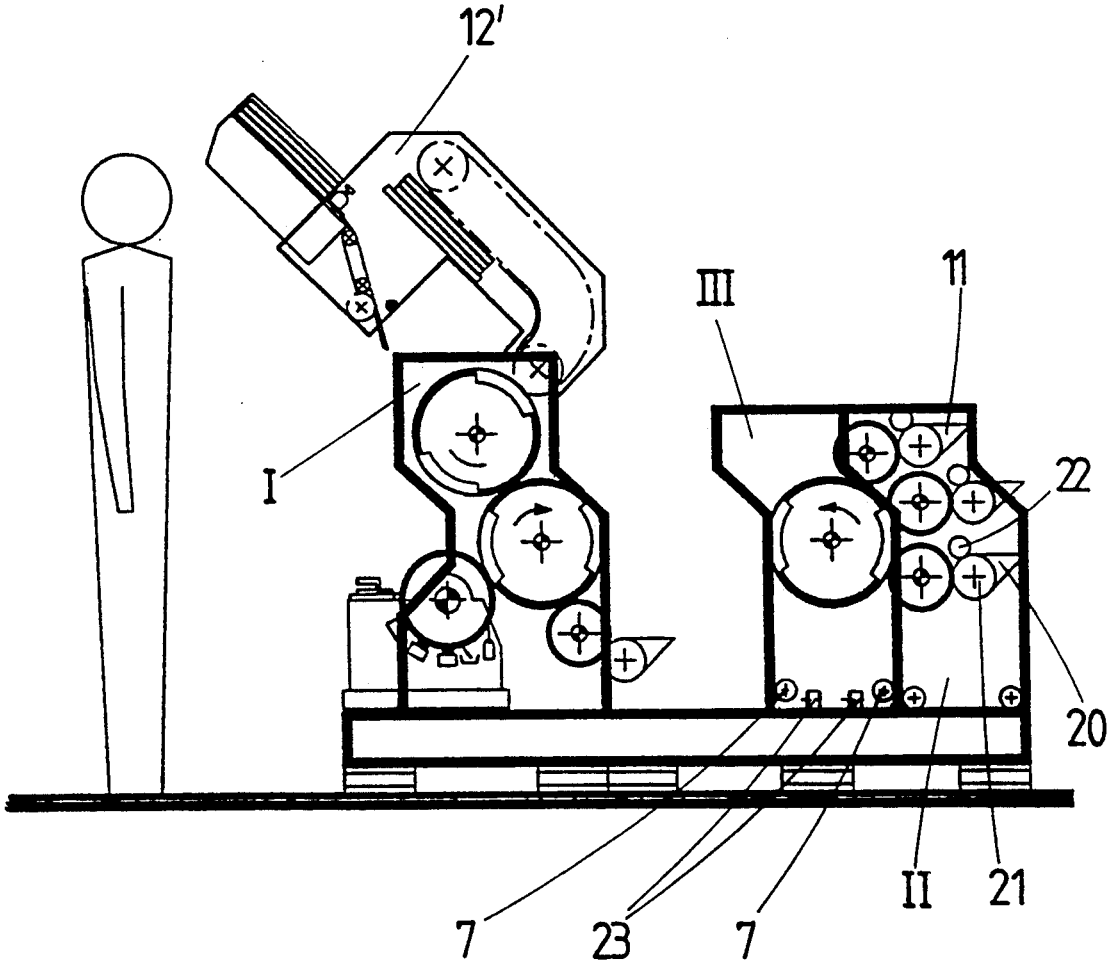
FIG. 2 shows the machine according to FIG. 1, with machine stands II and III moved off from machine stand I.
Figure 3:
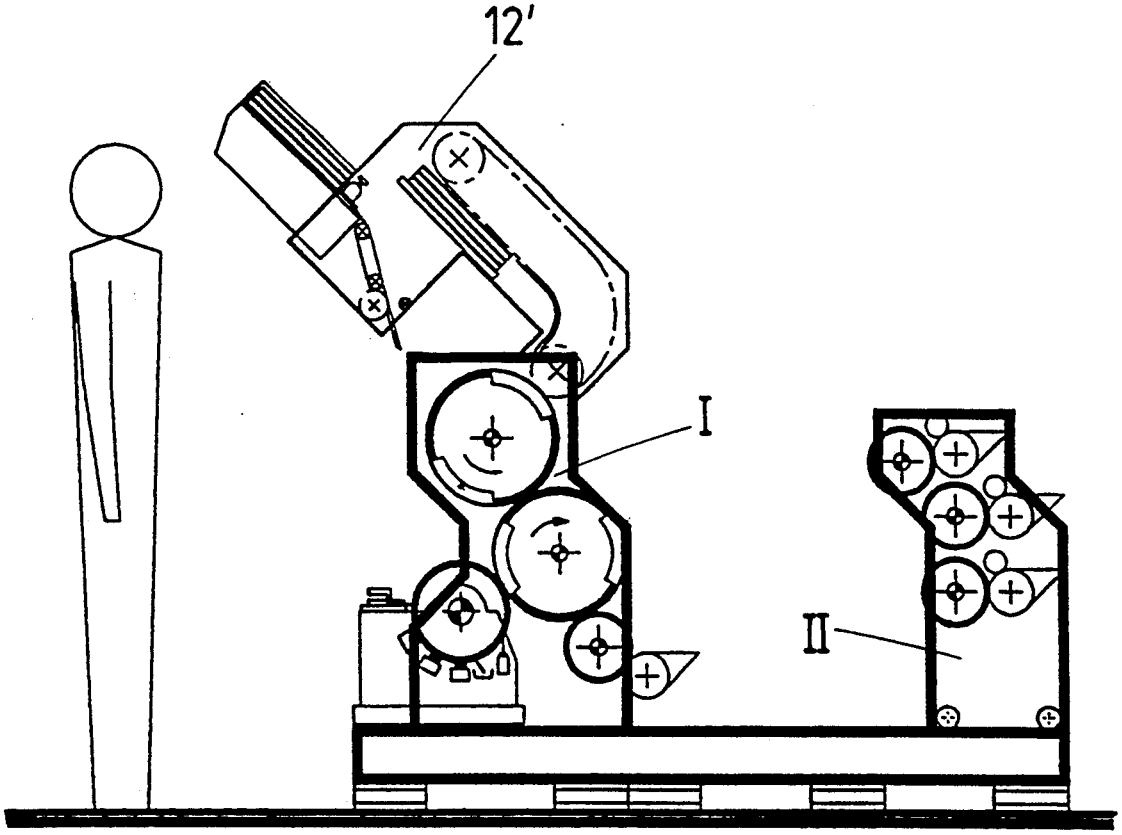
FIG. 3 shows the machine without the third machine stand, which carries the collect cylinder and which has been removed laterally (perpendicularly to the drawing plane), and with the second machine stand moved off.

In the illustration according to FIG. 2, machine stands II and III are moved off from machine stand I, the stand III being supported on the rollers 23, and in the illustration according to FIG. 3 the middle machine stand III together with the collect cylinder 8 has been removed laterally from the space between the two machine stands I and II, in that it has been moved laterally (perpendicularly to the drawing plane) on the rollers 23 into an inoperative position.

Figure 4:
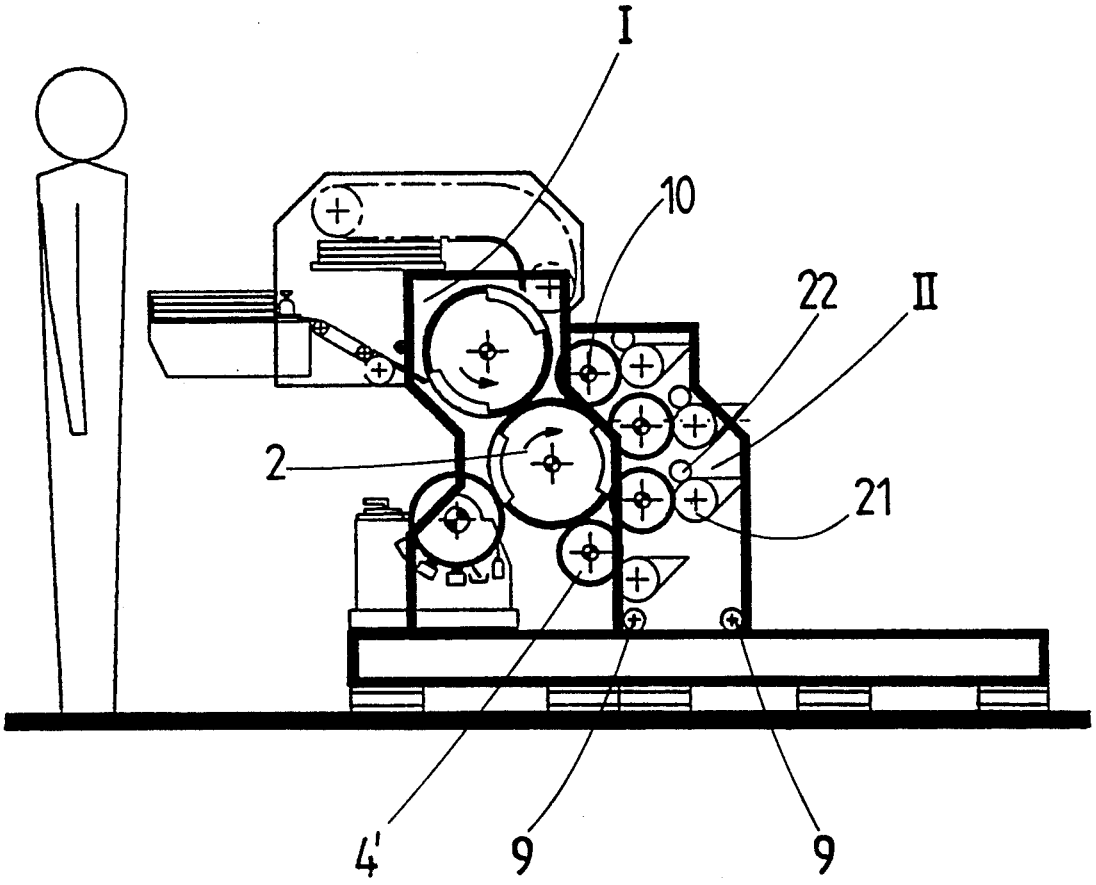
FIG. 4 shows that operating position in which the first and second machine stands form a direct intaglio printing machine.

With machine stand III removed, machine stand II can be pushed up against machine stand I, so that the stencil rollers 10 now touch the plate cylinder 2 directly, as shown in FIG. 4. FIG. 4 therefore shows the other operating position of the machine, in which a direct three-color intaglio printing is carried out. Since, as a rule, pre-wiping takes place in direct intaglio printing, in this case a pre-wiping cylinder 4' is mounted in machine stand I instead of a stencil roller.

The directions of rotation, indicated by curved arrows, of the impression cylinder 1 and the plate cylinder 2 are, of course, the same in both operating modes. In the collect intaglio printing according to FIG. 1, therefore, the stencil rollers 10 cooperate with a cylinder, in particular the color-collect cylinder 8, which has a direction of rotation different to that of the plate cylinder 2, with which these stencil rollers 10 cooperate in the direct intaglio printing according to FIG. 4. Their direction of rotation must therefore be reversible.

In the examples under consideration, the diagrammatically represented inking units are so-called short inking units which each consist only of an ink fountain 20, a ductor roller 21 and of an inking roller 22. So that the stencil rollers 10 can rotate in one direction or the other according to the operating mode, the arrangement in machine stand II is such that the ductor roller 21 or the entire ink fountain 20 with ductor roller 21, on the one hand, and the inking roller 22, on the other hand, can be adjusted into two operating positions. In the collect intaglio printing according to FIG. 1, the ductor rollers 21 are moved off somewhat from the stencil rollers 10 assigned to them, whilst the inking rollers 22 function as ink-transfer rollers and each roll both on a ductor roller 21 and a stencil roller 10. In contrast, in the direct intaglio printing according to FIG. 4, the ductor rollers 21 bear directly on the stencil rollers 10, and the inking rollers 22 function as ink distributor rollers which are moved off from the stencil rollers and which roll only on the ductor rollers 21.

The stencil rollers 10 can preferably carry stencil plates consisting of a somewhat elastic material, so-called flexoplates, which, without further action, are suitable both for inking the color-collect cylinder 8 in indirect intaglio printing and for the direct inking of the intaglio printing plates. As regards the indirect or collect intaglio printing according to FIG. 1, however, the stencil rollers 10 can also be covered with stencil plates consisting of a hard material which makes it possible to produce especially fine image elements. In this case, to convert the machine to direct intaglio printing according to FIG. 4, the stencil rollers are to be exchanged for those which have a somewhat elastic surface, because they cooperate directly with the hard intaglio printing plates.

In the exemplary embodiment according to FIGS. 5 and 6, machine stand III, together with the color-collect cylinder 8, the operating position III of which is indicated in FIG. 6, is not movable in a straight line, but pivotable laterally about a vertical axle 25, so that, as shown in the Figures, it can be pivoted laterally out of the space between machine stands I and II into the inoperative position III'. This vertical axle 25 is attached, for example, to a pillar 26 fastened to the machine stand I. The joint parts 27 are so designed that the laterally tilted-out stand III is offset next to the stand I to such an extent that the stand II together with the stencil rollers 10 can be moved up against the stand I. The remaining construction of the intaglio printing machine is the same as in the first exemplary embodiment.

The invention is not restricted to the exemplary embodiments described, but permits many alternative versions in terms of the design of the individual machine stands and their parts and of the manner of adjustment of the machine stands II and III. The machine according to the invention can also be a web-fed printing machine, in which the means for transporting the sheets are replaced by means for transporting the paper web.

I claim:

1. An intaglio printing machine having a plate cylinder (2) carrying at least one printing plate, an impression cylinder (1) cooperating with said plate cylinder (2), a wiping device (3) cooperating with the plate cylinder, a color-collect cylinder (8), stencil rollers (10) and inking units (11) inking these stencil rollers, the plate cylinder, impression cylinder and wiping device being mounted in a first machine stand (I), wherein the stencil rollers (10) and their inking units (11) are mounted in a second machine stand (II) which is adjustable in a direction oriented perpendicularly to the roller axes, wherein the color-collect cylinder (8) is mounted in a third machine stand (III) which can be removed from the space between the first and second machine stands, and adjusted into an inoperative position, and wherein the second machine stand (II) is designed, in a first operating position in which the color-collect cylinder (8) bears on the plate cylinder (2), to ink this color-collect cylinder (8) with its stencil rollers (10) and, in a second operating position in which the third machine stand (III) is located in said inoperative position, to ink the plate cylinder (2) with its stencil rollers (10).

2. The intaglio printing machine as claimed in claim 1, in which the inking units each have an ink fountain (20), a ductor roller (21) and an inking roller (22), wherein the ductor roller (21) or the entire ink fountain (20) with the ductor roller (21) and the inking roller (22) are mounted adjustably in the second machine stand (II), and wherein, in one of the said two operating positions, the ductor roller (21) bears on the stencil roller (10) assigned to it and the inking roller (22) rolls as an ink distributor roller on the ductor roller (21) without contact with the ductor roller, whilst, in the other said operating positions, the ductor roller (21) is moved off from the stencil roller (10) assigned to it and the inking roller (22) rolls as an ink-transfer roller both on the ductor roller (21) and on the stencil roller (10).

3. The intaglio printing machine as claimed in claim 1, wherein the stencil rollers (10) are covered with stencil plates consisting of an elastic material, in such a way that they are suitable both for inking the color-collect cylinder (8) and for the direct inking of the intaglio printing plates of the plate cylinder (2).

4. The intaglio printing machine as claimed in claim 1, wherein a bearing for receiving either a pre-wiping cylinder (4') or else a further stencil roller (4) for the direct inking of the intaglio printing plates and a further inking unit (5) assigned to the stencil roller are also provided in the first machine stand (I).

5. The intaglio printing machine as claimed in claim 1, which is designed as a sheet-fed printing machine with a sheet feeder (14) and a sheet delivery (15), wherein a sheet-supply device together with the sheet feeder (14) and a sheet-removal device together with the sheet delivery (15) are installed in a common stand (12) which is attached pivotably in the upper region of the first machine stand (I) and which is adjustable between an operating position and an inoperative position (12').

6. The intaglio printing machine as claimed in claim 5, wherein said stand (12) moreover also carries the entry table (13) for the entry stack (B) and the delivery table (19).

7. The intaglio printing machine as claimed in claim 1, wherein the third machine stand (III) is movable from the first machine stand (I) in a direction oriented perpendicularly to the cylinder axis and moreover is adjustable at right angles to this direction into the inoperative position.

8. The intaglio printing machine as claimed in claim 7, wherein the third machine stand (III) is provided with a first group of rollers (7), which serve for moving it off from the first machine stand and the axes of which are parallel to the cylinder axis, and a second group of rollers (23), the axes of which are perpendicular to the cylinder axis and which serve for displacing this machine stand (III) at right angles to the moving-off direction, and wherein the two groups of rollers are selectively retractable.

9. The intaglio printing machine as claimed in claim 1, wherein the third machine stand (III) is mounted pivotably on one side about a vertical axle (25), in such a way that it is pivotable out of its operating position laterally into the said inoperative position.

* * * * *